US008136852B1

(12) United States Patent
Thomas

(10) Patent No.: US 8,136,852 B1
(45) Date of Patent: Mar. 20, 2012

(54) DOOR LOCKING SYSTEM

(76) Inventor: John D. Thomas, Mount Sterling, IL (US)

( * ) Notice: Subject to any disclaimer, the term of this patent is extended or adjusted under 35 U.S.C. 154(b) by 202 days.

(21) Appl. No.: 12/369,280

(22) Filed: Feb. 11, 2009

(51) Int. Cl.
*E05C 19/18* (2006.01)

(52) U.S. Cl. ..... 292/288; 292/297; 292/194; 292/230; 292/DIG. 46

(58) Field of Classification Search ..... 292/288, 292/289, 297, 194, 230, 231, 238, 195, 202, 292/304, DIG. 46
See application file for complete search history.

(56) References Cited

U.S. PATENT DOCUMENTS

| | | | | |
|---|---|---|---|---|
| 936,164 | A | 10/1909 | Reid | |
| 1,166,791 | A | 1/1916 | Scroggins | |
| 2,373,783 | A * | 4/1945 | Schlifer | 70/101 |
| 2,532,586 | A | 12/1950 | Wickwire | |
| 3,025,693 | A | 3/1962 | Braginetz | |
| 4,098,530 | A | 7/1978 | Edeus | |
| 5,511,835 | A * | 4/1996 | Hardee | 292/238 |
| 5,791,173 | A * | 8/1998 | Montes | 70/101 |
| 6,679,530 | B2 * | 1/2004 | Krynski | 292/210 |
| D487,221 | S | 3/2004 | Vito | |
| 7,226,094 | B2 | 6/2007 | Swink | |
| 2006/0118253 | A1 | 6/2006 | Slusarski et al. | |

* cited by examiner

*Primary Examiner* — Tony H. Winner
*Assistant Examiner* — Jacob Knutson

(57) ABSTRACT

A door locking system includes a door that has an outer edge. The door is overlapped with a door frame in a dwelling wall when the door in a closed position. A mounting plate is attached to the outer edge and has an upper edge and a lower edge. A swing plate is pivotally coupled to the mounting plate by a pivot pin positioned adjacent to the upper edge. A stop plate is attached to the door frame and extends outwardly from the door frame. The mounting plate is abutted against the stop plate when the door is in a closed position overlapping the door frame. The stop plate is positioned below the pivot pin. The swing plate is pivoted over the stop plate in a locking position to position the stop plate between the swing plate and the mounting plate to prevent opening of the door.

7 Claims, 7 Drawing Sheets

DOOR LOCKING SYSTEM

BACKGROUND OF THE DISCLOSURE

Field of the Disclosure

The disclosure relates to door lock assemblies and more particularly pertains to a new door lock assembly for retaining a door in closed position.

SUMMARY OF THE DISCLOSURE

An embodiment of the disclosure meets the needs presented above by generally comprising a door that has an outer edge. The door is overlapped with a door frame in a dwelling wall when the door in a closed position. A mounting plate is attached to the outer edge and has an upper edge, a lower edge, a first lateral edge and a second lateral edge. A swing plate is pivotally coupled to the mounting plate by a pivot pin positioned adjacent to the upper edge. A stop plate is attached to the door frame and extends outwardly from the door frame. The mounting plate is abutted against the stop plate when the door is in a closed position overlapping the door frame. The stop plate is positioned below the pivot pin. The swing plate is pivoted over the stop plate in a locking position to position the stop plate between the swing plate and the mounting plate to prevent opening of the door.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
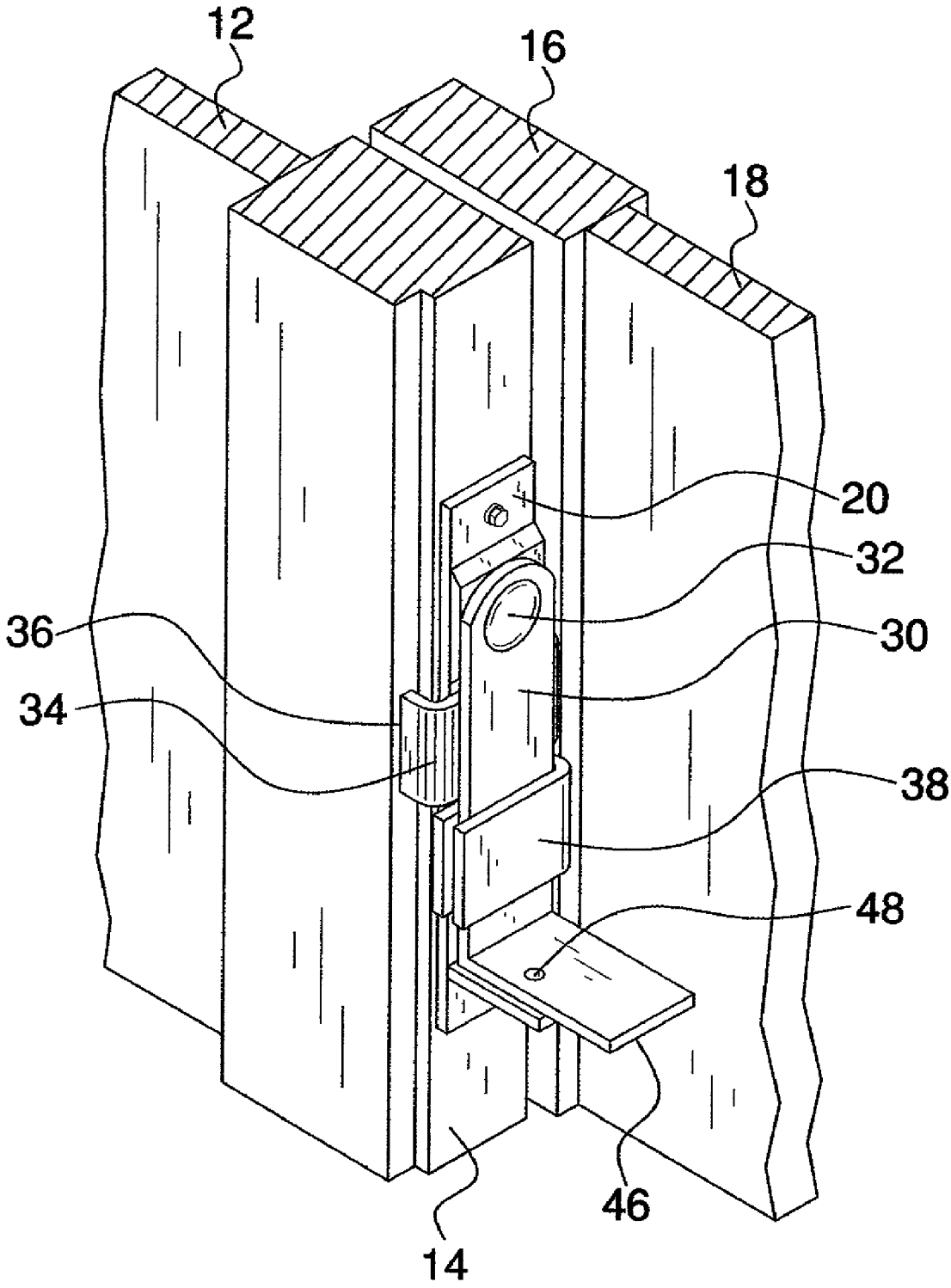
FIG. 1 is a front perspective view of a door locking system according to an embodiment of the disclosure.
Figure 2:
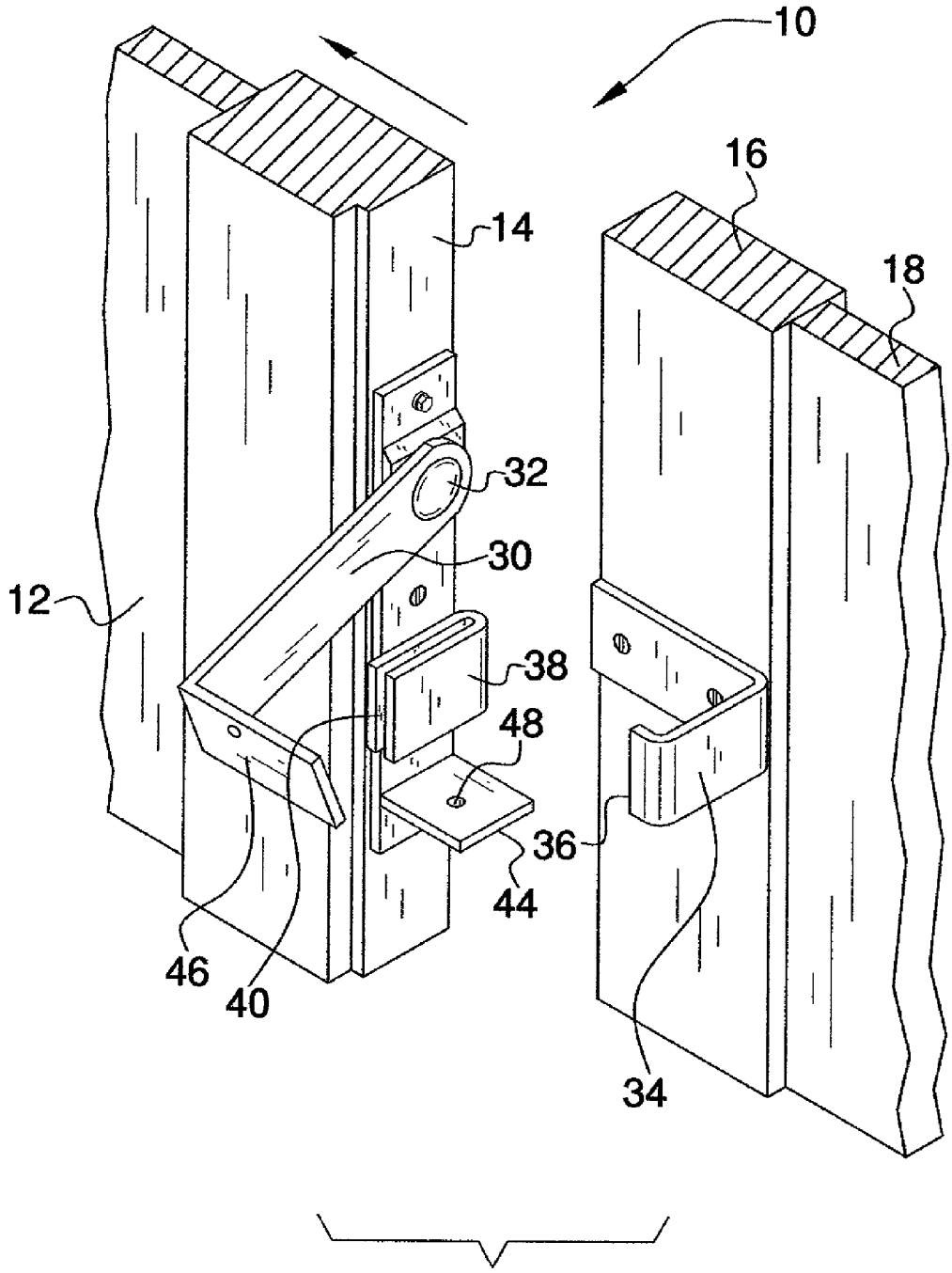
FIG. 2 is a front perspective view of an embodiment of the disclosure.
Figure 3:
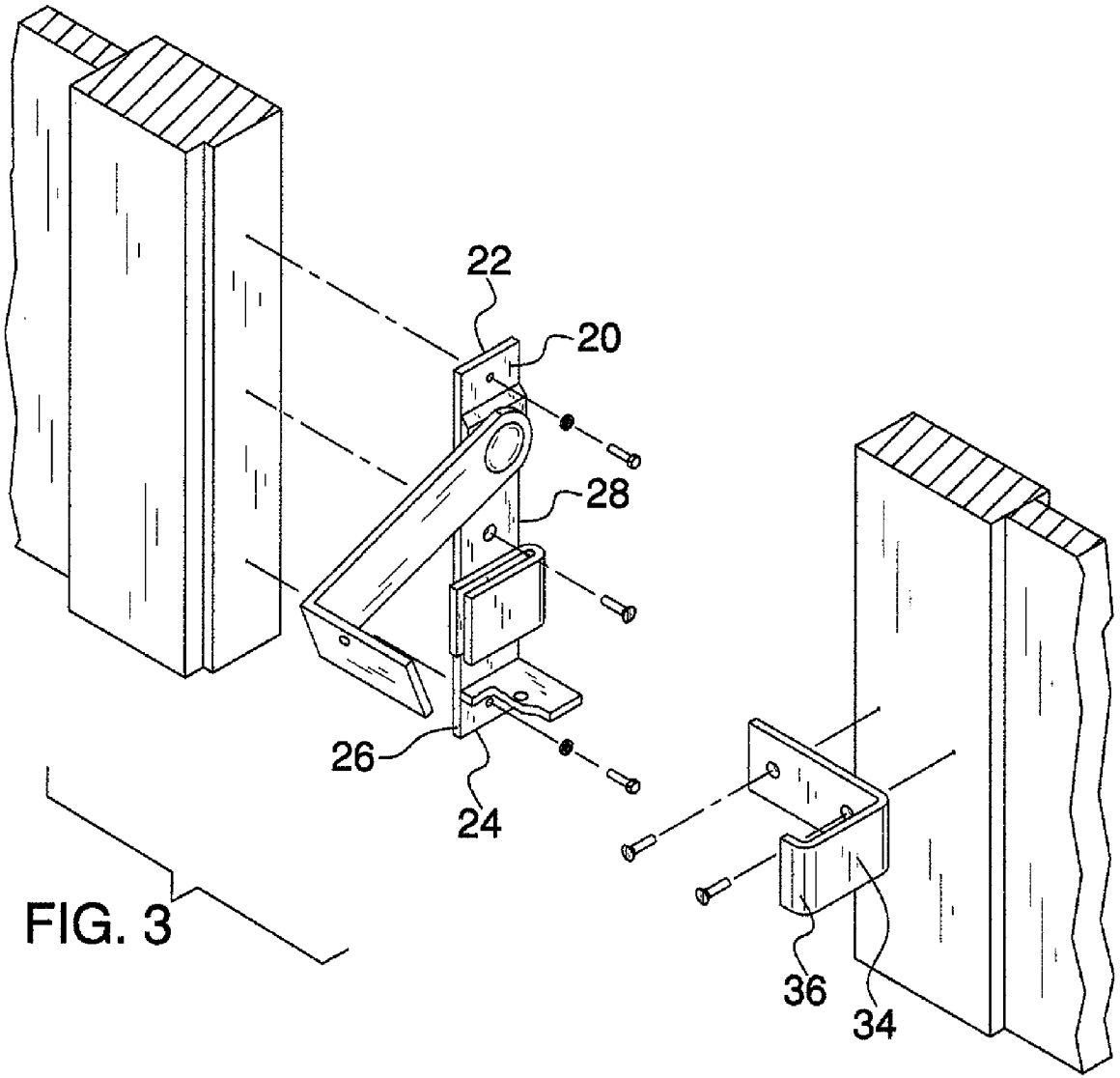
FIG. 3 is an exploded and broken front perspective view of an embodiment of the disclosure.
Figure 4:
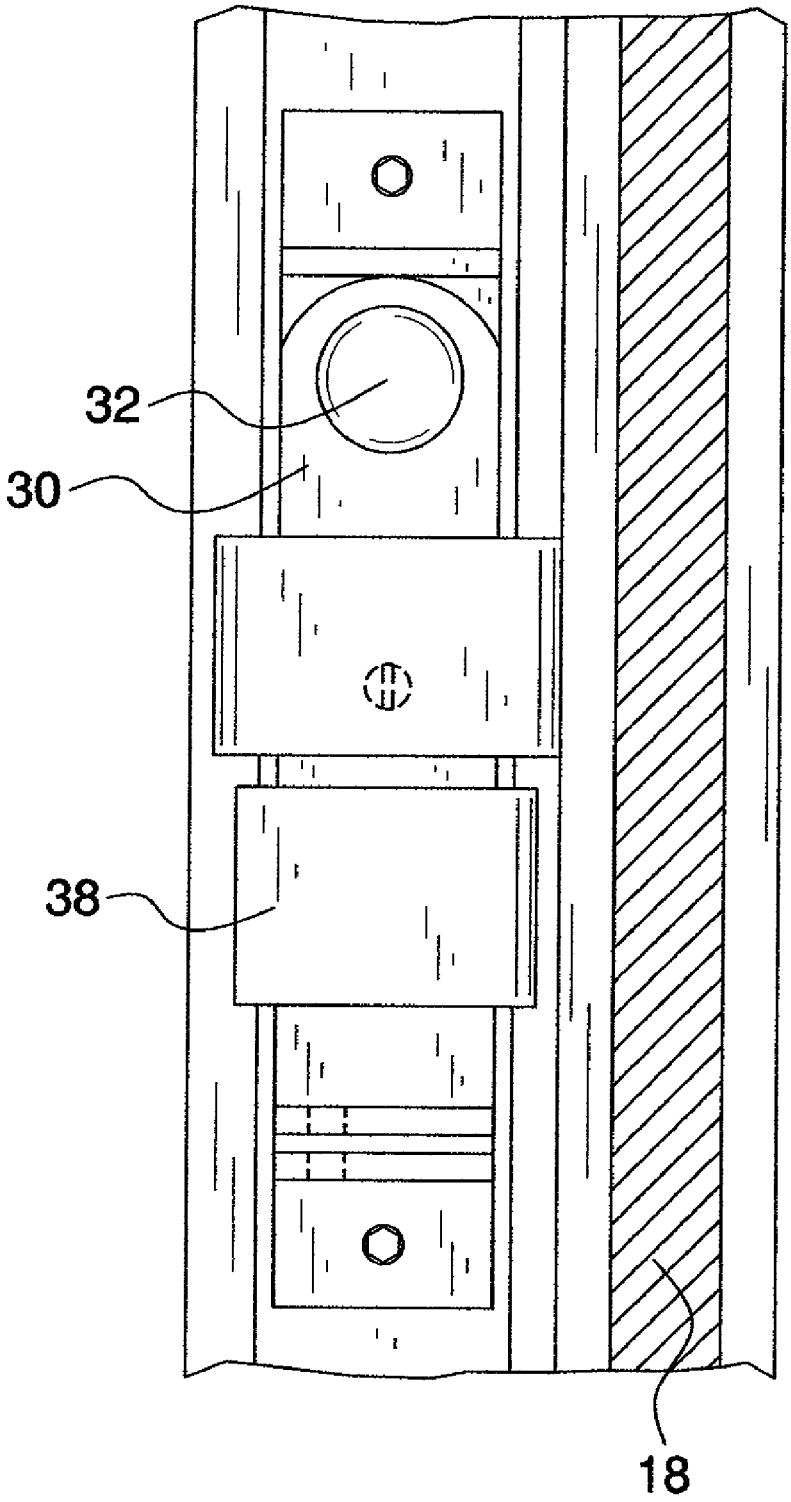
FIG. 4 is a side view of an embodiment of the disclosure.
Figure 5:
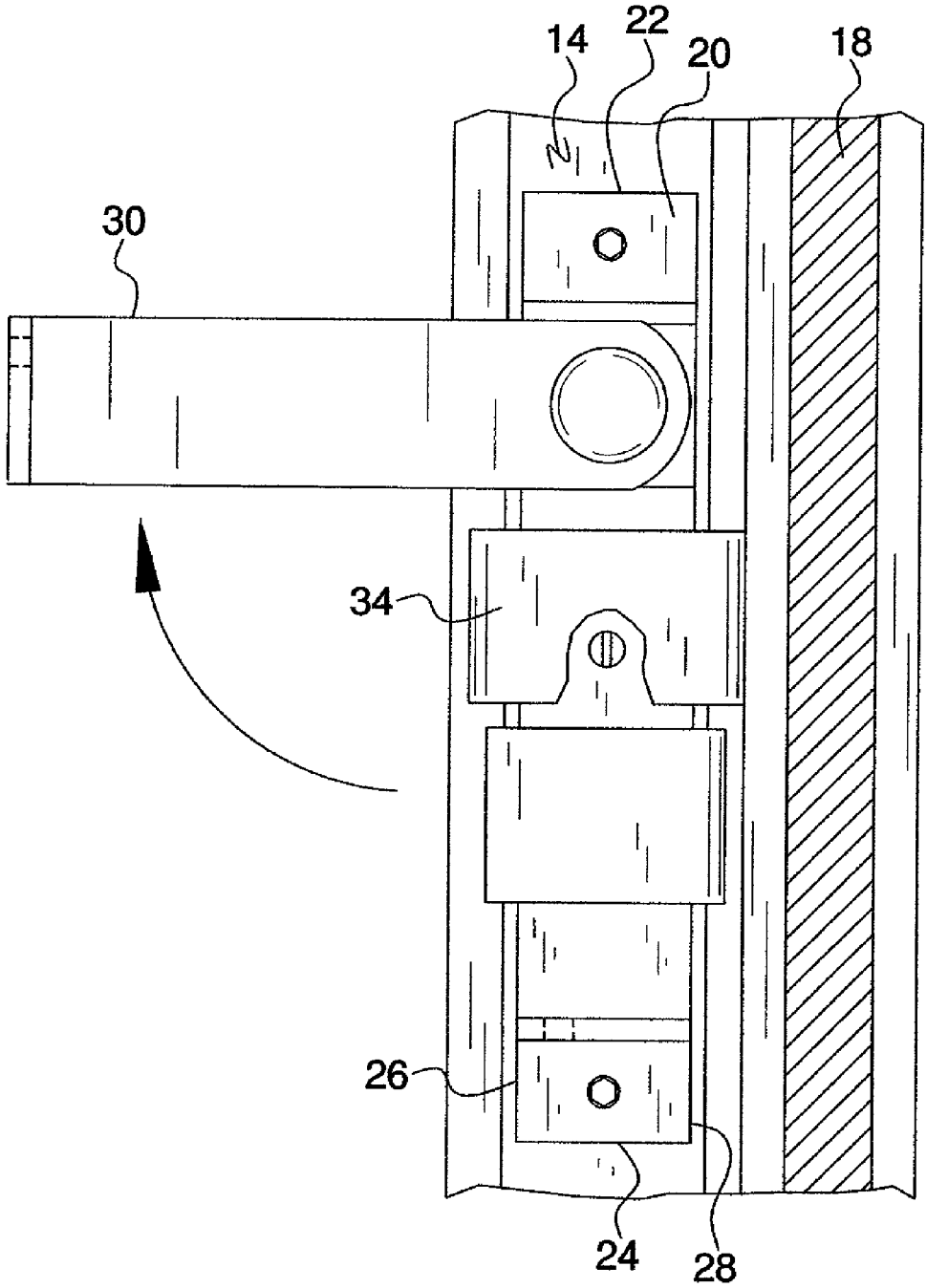
FIG. 5 is a side view of an embodiment of the disclosure.
Figure 6:
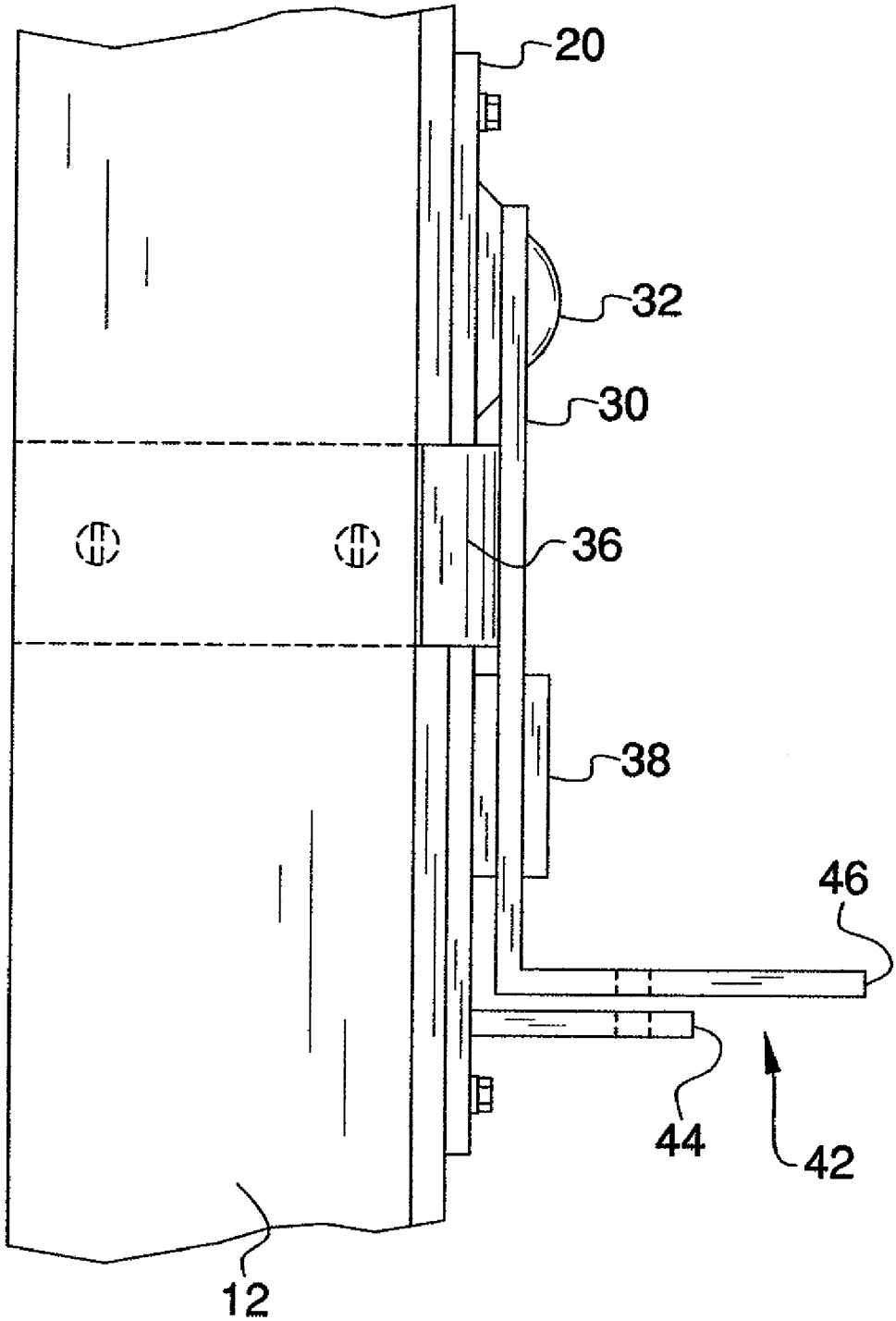
FIG. 6 is a front view of an embodiment of the disclosure.
Figure 7:
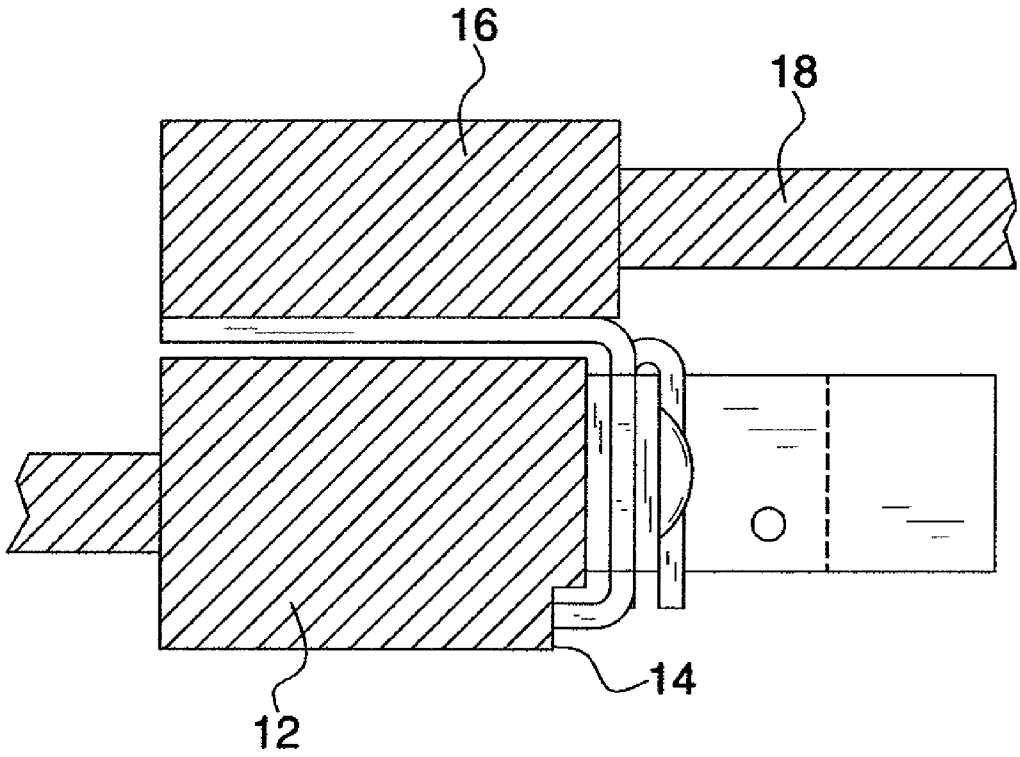
FIG. 7 is a top cross-sectional view of an embodiment of the disclosure.

With reference now to the drawings, and in particular to FIGS. 1 through 7 thereof, a new door lock assembly embodying the principles and concepts of an embodiment of the disclosure and generally designated by the reference numeral 10 will be described.

As best illustrated in FIGS. 1 through 7, the door locking system 10 generally comprises a door 12 has an outer edge 14. The door 12 is overlapped with a door frame 16 in a dwelling wall 18 when the door 12 in a closed position. The figures show the door 12, door frame 16 and dwelling wall 18 only partially as each is conventional. The door 12 may be a sliding a door and the dwelling wall 18 may be of any conventional dwelling but will likely include shed and barn type buildings used for storage and commerce purposes.

A mounting plate 20 is attached to the outer edge 14. The mounting plate 20 has an upper edge 22, a lower edge 24, a first lateral edge 26 and a second lateral edge 28. A swing plate 30 is pivotally coupled to the mounting plate 20 by a pivot pin 32 positioned adjacent to the upper edge 22. This allows the swing plate 30 to hang down from the upper edge 22 toward the lower edge 24 and swing laterally outward from the first 26 and second 28 lateral edges.

A stop plate 34 is attached to the door frame 16 and extends outwardly from the door frame 16. The mounting plate 20 is abutted against the stop plate 34 when the door 12 is in a closed position overlapping the door frame 16. The stop plate 34 may include a lip 36 attached to an outer end of the stop plate 34 which extends around the outer edge 14 of the door 12. The stop plate 34 is positioned below the pivot pin 32 and the swing plate 30 is pivoted over the stop plate 34 in a locking position to position the stop plate 34 between the swing plate 30 and the mounting plate 20 to prevent opening of the door 12.

A catch 38 is attached to the mounting plate 20. The catch 38 receives the swing plate 30 when the swing plate is in the locking position. The stop plate 34 is positioned between the pivot pin 32 and the catch 38 when the stop plate 34 is abutted against the mounting plate 20. The catch 38 is U-shaped and to form a slot 40 for receiving the swing plate 30.

A lock receiver 42 includes a lower plate 44 and an upper plate 46. The lower plate 44 is attached to the mounting plate 20 adjacent to the lower edge 24 and extends outwardly from the mounting plate 20. The upper plate 46 is attached to a bottom edge of the swing plate 30 positioned distal to the pivot pin 32. The upper plate 46 is orientated perpendicular to the swing plate 30. Each of the upper 46 and lower 44 plates has an aperture 48 extending therethrough and aligned with each other when the swing plate 30 is in the locking position. A padlock, not shown, is extendable through the apertures 48 in a conventional manner to prevent the swing plate 30 from being moved out of the locking position.

In use, the system 10 is used particularly with sliding doors which overlap with a door frame 16 and which are not conducive to conventional door fastening devices. The system 10 will prevent the accidental opening of the door 12, particularly from wind, which would expose the contents of the dwelling to the elements and which could damage objects struck by the door when 12 it was accidentally and forcefully opened.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A door locking system including:

a door having an outer edge, said door being overlapped with a door frame in a dwelling wall when said door in a closed position;

a mounting plate being attached to said outer edge, said mounting plate having an upper edge, a lower edge, a first lateral edge and a second lateral edge;

a swing plate being pivotally coupled to said mounting plate by a pivot pin positioned adjacent to said upper edge; and a stop plate being attached to said door frame and extending outwardly from said door frame, said mounting plate being abutted against said stop plate when said door is in a closed position overlapping the door frame, said stop plate being positioned below said pivot pin, said swing plate being pivoted over said stop plate in a locking position to position said stop plate between said swing plate and said mounting plate to prevent opening of said door.

2. The system according to claim 1, further including a catch being attached to said mounting plate, said catch receiving said swing plate when said swing plate is in said locking position.

3. The system according to claim 2, wherein said stop plate is positioned between said pivot pin and said catch when said stop plate is abutted against said mounting plate.

4. The system according to claim 1, further including a lock receiver including a lower plate and an upper plate, said lower plate being attached to said mounting plate adjacent to said lower edge and extending outwardly from said mounting plate, said upper plate being attached to a bottom edge of said swing plate positioned distal to said pivot pin, said upper plate being orientated perpendicular to said swing plate, each of said upper and lower plates having an aperture extending therethrough and aligned with each other when said swing plate is in said locking position, wherein a padlock is extendable through said apertures.

5. The system according to claim 1, said door having an outer face and an inner face, said outer edge being positioned between said outer and inner faces and defining a perimeter edge of said door, said swing plate being rotational about an axis extending into said outer edge and perpendicular to a plane of said outer edge.

6. A door locking system including:

a door having an outer edge, said door being overlapped with a door frame in a dwelling wall when said door in a closed position;

a mounting plate being attached to said outer edge, said mounting plate having an upper edge, a lower edge, a first lateral edge and a second lateral edge;

a swing plate being pivotally coupled to said mounting plate by a pivot pin positioned adjacent to said upper edge;

a stop plate being attached to said door frame and extending outwardly from said door frame, said mounting plate being abutted against said stop plate when said door is in a closed position overlapping the door frame, said stop plate being positioned below said pivot pin, said swing plate being pivoted over said stop plate in a locking position to position said stop plate between said swing plate and said mounting plate to prevent opening of said door;

a catch being attached to said mounting plate, said catch receiving said swing plate when said swing plate is in said locking position, said stop plate being positioned between said pivot pin and said catch when said stop plate is abutted against said mounting plate; and a lock receiver including a lower plate and an upper plate, said lower plate being attached to said mounting plate adjacent to said lower edge and extending outwardly from said mounting plate, said upper plate being attached to a bottom edge of said swing plate positioned distal to said pivot pin, said upper plate being orientated perpendicular to said swing plate, each of said upper and lower plates having an aperture extending therethrough and aligned with each other when said swing plate is in said locking position, wherein a padlock is extendable through said apertures.

7. The system according to claim 6, said door having an outer face and an inner face, said outer edge being positioned between said outer and inner faces and defining a perimeter edge of said door, said swing plate being rotational about an axis extending into said outer edge and perpendicular to a plane of said outer edge.

* * * * *